US005738248A

United States Patent [19]

Green

[11] Patent Number: 5,738,248

[45] Date of Patent: Apr. 14, 1998

[54] JUICE BEVERAGE DISPENSER

[75] Inventor: Thomas S. Green, Atwater, Ohio

[73] Assignee: ABC Dispensing Technologies, Inc., Akron, Ohio

[21] Appl. No.: 701,786

[22] Filed: Aug. 26, 1996

[51] Int. Cl.[6] ..... B67D 5/56

[52] U.S. Cl. ..... 222/129.2; 222/145.6; 222/318

[58] Field of Search ..... 222/129.1, 129.2, 222/133, 134, 145.5, 145.6, 135, 136, 318

[56] References Cited

U.S. PATENT DOCUMENTS

| | | | |
|---|---|---|---|
| 2,736,466 | 2/1956 | Rodth | 222/129.2 X |
| 3,640,433 | 2/1972 | Rodth | 222/129.2 |
| 4,194,650 | 3/1980 | Nottke et al. | 222/133 X |
| 4,795,061 | 1/1989 | Peckjian | 222/129.2 X |
| 4,886,190 | 12/1989 | Kirshner et al. | 222/129.1 X |
| 5,121,855 | 6/1992 | Credle, Jr. | 222/129.2 |
| 5,170,912 | 12/1992 | Du | 222/136 X |
| 5,181,631 | 1/1993 | Credle, Jr. | 222/129.2 |
| 5,433,349 | 7/1995 | Romanyszyn, Jr. | 222/129.2 |
| 5,570,822 | 11/1996 | LeMarbe et al. | 222/145.6 X |

*Primary Examiner*—Kevin P. Shaver

*Attorney, Agent, or Firm*—Renner, Kenner, Greive, Bobak, Taylor & Weber

[57] ABSTRACT

A juice beverage dispenser employs a fixed ratio pump interposed between a source of juice concentrate and a source of water. The water drives the pump such that the water and juice concentrate outputs from the pump are presented in a fixed ratio independent of water pressure or juice concentrate viscosity. The outputs from the pump are passed to a check valve/premixer which blends the water and juice concentrate into a premixed blend for passage to a final mixer. A bypass line interconnects the source of water and the final mixer and has therein a metering valve with an adjustable orifice. By adjusting the orifice of the metering valve, the final ratio of juice concentrate and water in the final juice beverage may be established.

19 Claims, 1 Drawing Sheet

JUICE BEVERAGE DISPENSER

TECHNICAL FIELD

The invention herein resides in the art of dispensing devices and, more particularly, to liquid dispensers. Specifically, the invention relates to a juice beverage dispenser in which the ratio of juice concentrate to water may be accurately maintained.

BACKGROUND ART

The desirability of mixing or blending liquids into a final solution of a particular ratio has been well known. Typically, beverage dispensers include a main ingredient such as plain water or carbonated water (soda) which is mixed with a flavoring syrup. Soft drinks are of such a basic nature. Similarly, juice beverages may be made by blending juice concentrate and water at a particular ratio. In such beverage dispensers, it is typically of critical importance that the ratio between syrup or concentrate and the major volume ingredient such as soda or water be constant. In other words, the brix of resultant drinks must be at a specific and consistent level from one dispensing cycle to the next. Each beverage has its own peculiarities with respect to the dispensing operation.

In the dispensing of soft drinks, the syrup is often of fluctuating viscosity and of a tacky nature. In juice dispensers, the juice concentrate is also characterized by varying viscosity and, along with being somewhat tacky, the concentrate also is often characterized by the presence of pulp or particulate matter. Such characteristics make the uniform dispensing of the beverage a difficult proposition and the presence of pulp or particulate matter often leads to clogging or the prevention of valve seating. Moreover, fluctuations in the viscosity of the juice concentrate renders it difficult to maintain a juice beverage of consistent brix. While fixed ratio pumps may be used for such dispensing operations, such pumps are generally not configured to provide dispensing at the desired ratio for beverages. Moreover, such fixed ratio pumps have been known to pass a "slug" of water or other driving fluid at the reversal on each half cycle of the pump, resulting in stratification or non-uniformity of the dispensed beverage.

There is a need in the art for a beverage dispenser which is capable of mixing and dispensing beverages of uniform ratio or brix, and which is effective in operation despite the inherent characteristics and anomalies of flavoring syrup and juice concentrates.

DISCLOSURE OF INVENTION

In view of the foregoing, it is a first aspect of the invention to provide a juice beverage dispenser which blends a beverage from a fixed ratio of water and juice concentrate, and does so irrespective of the viscosity of the juice concentrate.

Another aspect of the invention is to provide a juice beverage dispenser employing a fixed ratio pump and an associated adjustable metering valve to allow for the setting of a specific desired beverage brix.

Yet another aspect of the invention is the provision of a juice beverage dispenser both a premixer and final mixer to assure uniformity throughout the beverage.

Yet another aspect of the invention is the provision of a juice beverage dispenser in which the system is not given to adverse effects from the tackiness of the syrup or concentrate, or the presence of pulp or particulate matter therein.

Yet an additional aspect of the invention is the provision of a juice beverage dispenser which is reliable and durable in operation, highly accurate and consistent in performance, and easy to construct from state of the art elements.

The foregoing and other aspects of the invention which will become apparent as the detailed description proceeds are achieved by a juice beverage dispenser, comprising: a source of juice concentrate; a source of water; a fixed ratio pump connected to said sources of juice concentrate and water and producing outputs of juice concentrate and water in a set ratio characteristic of said pump; mixing means connected to said outputs for receiving said juice concentrate and water and blending the same into a juice beverage; and augmentation supply means interposed between one of said sources of juice and water and said mixing means for altering a ratio of juice concentrate and water in said juice beverage from said set ratio.

Other aspects of the invention which will become apparent herein are attained by a juice beverage dispenser, comprising: a source of juice concentrate; a source of water; a fixed ratio pump connected to said sources and having outputs of water and juice concentrate presented in a fixed ratio; a premixer receiving and blending said outputs of water and juice concentrate into a premixed juice beverage; a final mixer connected to said premixer and receiving said premixed juice beverage; and a conduit interconnecting one of said sources of juice and water with said final mixer, said conduit having a metering valve therein.

DESCRIPTION OF THE DRAWINGS

For a complete understanding of the objects, techniques, and structure of the invention reference should be made to the following detailed description and accompanying drawing wherein.

BEST MODE FOR CARRYING OUT THE INVENTION

Figure 1:
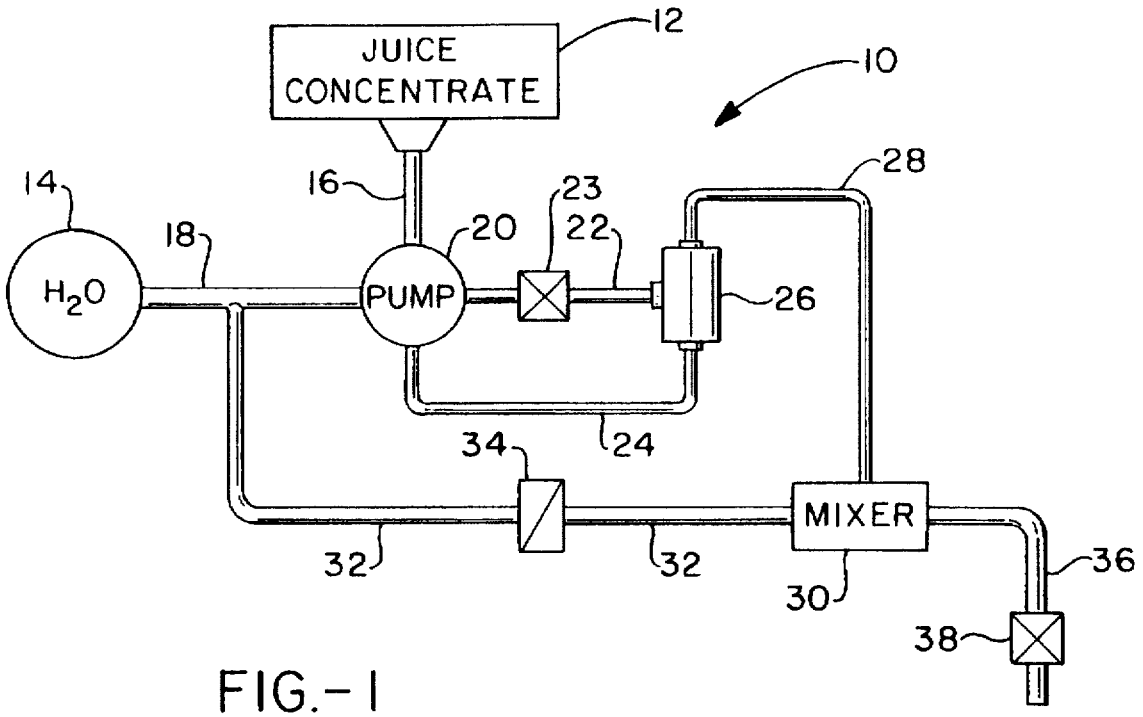
FIG. 1 is a functional block diagram of the juice beverage dispenser according to the invention.

Referring now to the drawing and more particularly FIG. 1, it can be seen that a juice beverage dispensing system according to the invention is designated generally by the numeral 10. It will be appreciated that, although the invention herein is described with respect to a juice beverage dispenser, the concept and structure of the invention is equally applicable to the dispensing of any fluid or beverage in which a constant and consistent ratio of constituent ingredients is desired. In the context of a juice beverage dispenser, the system 10 includes a source of juice concentrate 12 and a pressurized water supply 14. Conduits 16, 18 respectively interconnect the juice concentrate source 12 and water supply 14 with a pump 20. In accordance with the preferred embodiment of the invention, the pump 20 is a fixed ratio pump. In such a pump, the outputs of the pump 20 are the same as the inputs, in a fixed ratio characteristic of the pump.

In the embodiment shown, water under pressure passes from the source 14, through the conduit 18, and into the pump 20. The water drives the pump which also receives juice concentrate from the source 12 through the conduit 16. As the pump 20 is driven by the water, the pump presents an output of juice concentrate through the conduit 22 and water through the conduit 24. The ratio of the volumes of concentrate to water are fixed as a characteristic of the pump. Those skilled in the art will readily appreciate that such a fixed ratio pump may have any of a number of ratios such as 5:1, 4:1, 3.5:1, etc. A typical pump suitable for the instant invention is the SHURflo Brix Pump, as described in SHURflo Publication 911–332, Rev. G, dated March, 1994. It is particularly noteworthy that since the pump 20 operates as a fixed ratio pump, the ratio of juice concentrate to water presented at the outputs of the pump 20 are constant, irrespective of any changes in viscosity in the concentrate.

Interposed within the conduit 22 for juice concentrate is an appropriate check valve 23 to prevent any back flow of juice concentrate into the pump 20 upon termination of operation.

The conduits 22, 24 are interconnected with a check valve/premixer 26 and respectively pass juice concentrate and water thereto. In check valve/premixer 26 the water and juice concentrate are premixed into a blend of a substantially homogenous nature. The blend is passed through a conduit 28 to a final mixer 30. This final mixer may be either a static or dynamic mixer, providing mixing either by passing over and around baffles and the like or in which an agitator or appropriate impeller is electrically or mechanically actuated. Final blending of the fruit juice beverage is accomplished in the final mixer 30.

As shown, a bypass conduit 32 interconnects the water conduit 18 and final mixer 30. A metering valve 34 having an adjustable orifice is interposed within the conduit 32. It will be appreciated that the conduit 32 allows an additional volume of water having a flow rate established by the metering valve 34 to pass to the mixer 30. By adjusting the orifice of the metering valve 34, the rate of water flow and, accordingly, the volume of water dispensed during any fixed dispensing cycle can be set. Consequently, the metering valve 34 can be used to fine tune or coarsely adjust the ultimate brix of the juice beverage. In other words, if the pump 20 is set at a 4:1 ratio, but the desired ratio is 4.1:1, the metering valve 34 may be finely adjusted to establish the final desired brix. By the same token, if a 10:1 ratio is desired, the metering valve may be adjusted to accommodate that brix as well.

The output of the mixer 30 is interconnected to a dispensing line 36 having a dispensing valve 38 interposed therein. The dispensing valve 38 may be of any suitable nature, being either mechanically or electrically actuated. Suffice it to say that the ultimate juice beverage is dispensed from the dispensing line 36 through the dispensing valve 38 and out of an appropriate dispensing head and into a cup or other receptacle.

Figure 2:
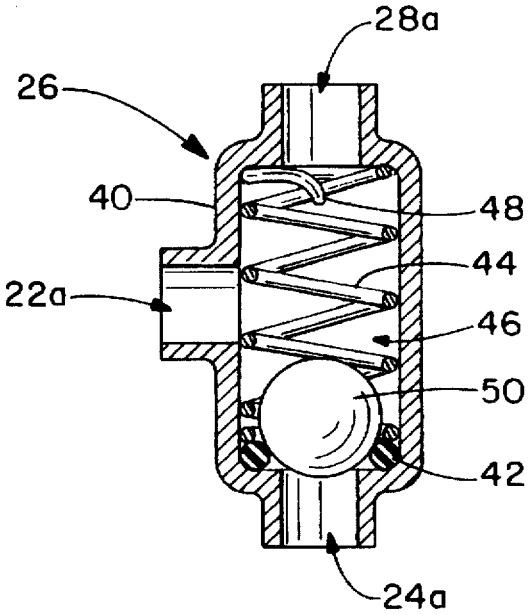
FIG. 2 is a cross sectional view of the check valve/premixer of the invention.

With reference now to FIG. 2, it can be seen that the check valve/premixer 26 is defined by a housing 40 having apertures 22*a*, 24*a*, and 28*a* respectively interconnected to the juice concentrate conduit 22, the water conduit 24, and the output conduit 28. An O-ring seal 42 is maintained about the aperture 24*a* within the cavity 46 of the housing 40. A spring 44 is also maintained within the cavity 46 and serves to engage the O-ring 42 to retain it in place. The spring 44 is compressed within the cavity 46 between the top wall of the cavity and the O-ring 42. A spring tab 48 extends downwardly from the top end of the spring 44 and in alignment with the aperture 28*a*. A stainless steel ball 50 or other appropriate spherical object is received by the cavity 46 and is movable within the spring 44. When the dispensing valve 38 is closed and the system 10 is in a quiescent state, the ball 50 seats upon the O-ring seal 42 and serves as a check valve to prevent the back flow of the liquid contained within the cavity 46 back into the conduit 24. Of course, the check valve 23 within the conduit 22 serves a similar purpose. It will also be appreciated that the ball serves as an agitator in the check valve/premixer 26. When the valve 38 is opened, the water pressure from the source 14 causes the pump 20 to operate, passing juice concentrate and water in a fixed ratio into the cavity 46 through the respective apertures 22*a*, 24*a*. The incoming water lifts the ball 50 from the O-ring 42 and urges it up toward the downwardly extending tab 48. It has been found that the ball 50 tends to reciprocate between the tab 58 and the O-ring 42 during the dispensing operation. This reciprocation or "chatter" of the ball 50 provides agitation within the cavity 46 which causes a premix between the water and juice concentrate which is then passed through the outlet 28*a* and through the conduit 28 to the final mixer 30.

Since the ball 50 and O-ring 42 are constantly being washed by water coming in through the inlet 24*a*, the valve seat between the O-ring 42 and the valve ball 50 are always clean, assuring that positive sealing action is attained and no clogging is experienced. The blend generated within the cavity 46 is then finally mixed with an augmented amount of water introduced through the metering valve 34 and conduit 32 to the final mixer 30. Accordingly, a fruit juice beverage of repeatable consistency may be attained at the dispensing head.

It will be readily appreciated by those skilled in the art that the bypass of the conduit 32 and metering valve 34 could be employed in the juice concentrate dispensing arm, being interposed between the conduits 16 and 22. However, since the viscosity of water is unaffected by changes in the ambient, it is generally preferred that the augmentation line be interposed between the conduit 18 and mixer 30 as shown and described above.

It will be appreciated by those skilled in the art that since the pump 20 is a fixed ratio pump, the ratio of juice concentrate to water will remain constant irrespective of changes in the concentrate viscosity. It will further be appreciated that the ratio of the final juice beverage is also unaffected by changes in water pressure at the water supply 14. Such changes would only effect the rate of flow, but not the ratio.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A juice beverage dispenser, comprising:

a source of juice concentrate;

a source of water;

a fixed ratio pump connected to said source of juice concentrate and water and producing outputs of juice concentrate and water in a set ratio characteristic of said pump;

mixing means connected to said outputs for receiving said juice concentrate and water and blending the same into a juice beverage; and augmentation supply means interposed between one of said sources of juice and water and said mixing means for altering a ratio of juice concentrate and water in said juice beverage from said set ratio.

2. The juice beverage dispenser according to claim 1, wherein said augmentation supply means comprises a conduit having a metering valve therein.

3. The juice beverage dispenser according to claim 2, wherein said metering valve has an adjustable orifice.

4. The juice beverage dispenser according to claim 3, wherein said conduit is interposed between said source of water and said mixing means.

5. The juice beverage dispenser according to claim 2, wherein said mixing means comprises a static mixer.

6. The juice beverage dispenser according to claim 2, wherein said mixing means comprises a dynamic mixer.

7. The juice beverage dispenser according to claim 2, wherein said mixing means comprises a premixer connected to said outputs and blending said juice concentrate and water into a premixed juice beverage, and a conduit interconnecting said premixer and a final mixer, said conduit passing said premixed juice beverage from said premixer to said final mixer.

8. The juice beverage dispenser according to claim 7, wherein said augmentation supply means interconnects with said final mixer.

9. The juice beverage dispenser according to claim 7, wherein said premixer comprises a housing having first and second inlets respectively connected to said outputs of said fixed ratio pump, and an outlet connected to said conduit interconnecting said premixer and final mixer.

10. The juice beverage dispenser according to claim 9, wherein said housing receives a ball movable therein.

11. The juice beverage dispenser according to claim 10, wherein said first inlet has a seat adapted to receive said ball.

12. The juice beverage dispenser according to claim 11, wherein said seat comprises an O-ring, and further comprises a spring maintaining said O-ring at said first inlet, said ball being movable within said spring.

13. The juice beverage dispenser according to claim 12, wherein said spring has a tab at one end thereof, said tab precluding said ball from engaging said outlet.

14. The juice beverage dispenser according to claim 13, wherein said first inlet connects to said output of water of said fixed ratio pump.

15. The juice beverage dispenser according to claim 14, further comprising a check valve interposed between said output of juice concentrate and said second inlet.

16. A juice beverage dispenser, comprising:

a source of juice concentrate;

a source of water;

a fixed ratio pump connected to said sources and having outputs of water and juice concentrate presented in a fixed ratio;

a premixer receiving and blending said outputs of water and juice concentrate into a premixed juice beverage;

a final mixer connected to said premixer and receiving said premixed juice beverage; and a conduit interconnected to one of said sources of juice and water with said final mixer, said conduit having a metering valve therein.

17. The juice beverage dispenser according to claim 16, wherein said metering valve is adjustable.

18. The juice beverage dispenser according to claim 17, wherein said premixer comprises a bail received within a housing, said ball agitating water and juice concentrate into said premixed juice beverage.

19. The juice beverage dispenser according to claim 18, wherein said ball seats against an inlet for said water.

* * * * *